US009806407B2

(12) United States Patent
Broemer et al.

(10) Patent No.: US 9,806,407 B2
(45) Date of Patent: Oct. 31, 2017

(54) SAFETY RADIO DEVICES

(75) Inventors: Dale Broemer, Okotoks (CA); Kelly Englot, Calgary (CA); Patrick Gonia, Maplewood, MN (US); AnjayaChary Boddupally, Bangalore (IN)

(73) Assignee: Honeywell International Inc., Morris Plains, NJ (US)

( * ) Notice: Subject to any disclaimer, the term of this patent is extended or adjusted under 35 U.S.C. 154(b) by 202 days.

(21) Appl. No.: 13/591,916

(22) Filed: Aug. 22, 2012

(65) Prior Publication Data

US 2014/0055303 A1 Feb. 27, 2014

(51) Int. Cl.
*H01Q 1/38* (2006.01)
*H01Q 1/24* (2006.01)
*H01Q 1/40* (2006.01)

(52) U.S. Cl.
CPC ..... *H01Q 1/38* (2013.01); *H01Q 1/243* (2013.01); *H01Q 1/40* (2013.01)

(58) Field of Classification Search
CPC ..... H01Q 1/38
USPC ..... 343/700 MS
See application file for complete search history.

(56) References Cited

U.S. PATENT DOCUMENTS 6,712,284 B2 * 3/2004 Aoki ..... H01L 23/552 257/183
6,906,411 B1 * 6/2005 Katsura ..... H01L 23/50 257/664
6,936,713 B2 * 8/2005 Masai ..... C07D 473/40 544/264
7,045,440 B2 * 5/2006 Huff ..... B81B 7/0064 257/703
7,408,512 B1 * 8/2008 Rodenbeck ..... H01Q 1/2208 343/700 MS
7,599,190 B2 * 10/2009 Okubora ..... H01L 23/49833 361/760
8,609,464 B2 * 12/2013 Oikawa ..... H01L 23/60 257/701
2006/0158865 A1 * 7/2006 Ohmi ..... H05K 1/024 361/795
2009/0058733 A1 * 3/2009 Kurashima ..... H01Q 1/22 343/700 MS
2009/0315320 A1 * 12/2009 Finn ..... B32B 37/1207 283/107
2010/0289719 A1 11/2010 Wang et al.
2011/0133850 A1 * 6/2011 Murase ..... H05K 1/0228 333/101

(Continued)

OTHER PUBLICATIONS

A planar chip antenna for 2.4/5.2GHz ISM band; Antennas and Propagation Society International Symposium, 2005 IEEE, Issue Date: Jul. 8-8, 2005, Written by: Chih-Yi Fang; Li-Sheng Cheng; Jen-Hsun Li; Chang-Fa Yang; Jun-Hong Lin; Chang-Lun Liao; Chia-Hung Chen; Shun-Tian L in; Kuo-Chung Cheng; Sea-Fue Wang; Meng-Chiu Pan; Chun-Ling Hu; Yu-Ching Chien.*

*Primary Examiner* — Dameon E Levi
*Assistant Examiner* — Andrea Lindgren Baltzell
(74) *Attorney, Agent, or Firm* — Brooks, Cameron & Huebsch, PLLC

(57) ABSTRACT

Safety radio devices are described herein. One method of constructing a safety radio device includes mounting a radio module on a first layer of a circuit board, fabricating an antenna on a second layer of the circuit board, and constructing a safety radio device by connecting the radio module to the antenna through an aperture formed in the second layer of the circuit board.

19 Claims, 3 Drawing Sheets

(56) References Cited

U.S. PATENT DOCUMENTS

2011/0161044 A1 6/2011 Gonia et al.

* cited by examiner

SAFETY RADIO DEVICES

TECHNICAL FIELD

The present disclosure relates to safety radio devices.

BACKGROUND

In many environments, it may be desirable to detect accumulations of potentially hazardous gases. If a hazardous gas and/or a particulate matter accumulates to an explosive level, a spark from an electrical device can potentially cause an explosion and/or a fire.

A gas sensing device can be used to detect accumulations of hazardous gases and send a notification and/or alarm upon sensing a threshold quantity of a gas. An industrial plant, for example, may deploy a gas sensing system including gas sensing devices distributed throughout the plant. Such a system may also include one or more central monitoring stations, which receive signals from the gas sensing devices. If one of the gas sensing devices detects an amount of gas above a threshold quantity, for example, then an alarm condition is triggered at the central station. Such gas sensing systems may further alert an operator so that an action may be taken to preclude a potentially harmful result within the plant.

While such systems can be effective, it may be of importance that the gas sensing devices cannot cause the ignition of any hazardous gas and/or particulates in an environment. When a gas sensing device is capable of communicating wirelessly, there may be some concern that the radio of the gas sensing device and/or its antenna may cause an ignition.

DETAILED DESCRIPTION

Figure 1A:
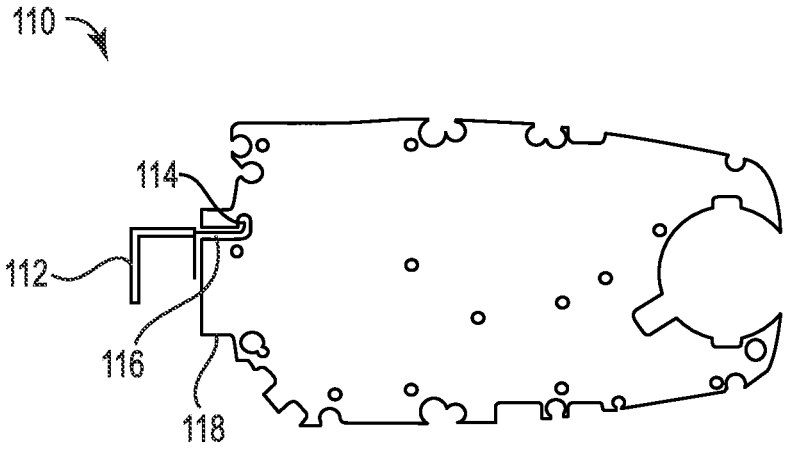
FIG. 1A illustrates a second layer of a circuit board of a safety radio device in accordance with one or more embodiments of the present disclosure.

Embodiments to the present disclosure include a wireless location-based system for detecting hazardous conditions. Such systems can be used to send notification of gas detection events.

For example, a wireless location-based system for detecting hazardous conditions can provide quick centralized access to information regarding gas detection events, including the location of the event(s) and/or location-based gas detection historical information. Further, a wireless location-based system may not need expensive wiring to connect some or all of the gas sensing devices to the central station.

A gas sensing device can be used to detect and send a notification of the presence of hazardous gases and/or chemicals. A gas sensing device can be used in a wireless location-based system, for example. In some such systems, the notification may be sent wirelessly using a safety radio device in accordance with one or more embodiments of the present disclosure.

A safety radio device in accordance with one or more embodiments of the present disclosure can comprise a radio module including electronic circuitry and components that can drive the input to and receive signals from an antenna and an antenna can be capable of converting electric currents into radio waves, and vice versa. Sending a signal, such as a radio frequency (RF) signal, in the presence of flammable and/or hazardous gases can result in the creation of a spark if enough energy is created in the circuit driving the antenna. However, in such environments a spark would likely be undesirable. The safety radio device can, for instance, provide the necessary RF signals for communications while avoiding igniting a flammable gas in the environment.

Previous safety radio devices used in hazardous environments can use isolation materials, such as an epoxy material, to prevent the ignition of flammable gas. The antenna and/or the safety radio device can, for example, be covered in an epoxy to prevent a spark from reaching the environment by isolating the antenna and the radio module from the explosive environment. However, covering the entire safety radio device in an epoxy can be expensive, time consuming, and/or can limit the RF capabilities of the radio device. Further, covering the antenna with epoxy to protect the antenna from access to the environment may detrimentally affect the tuning or performance of the antenna and/or cause manufacturing difficulties with reliable control of the resultant dimensions of the epoxy material.

In contrast, safety radio devices in accordance with one or more embodiments of the present disclosure may include an antenna fabricated on an inner layer of a circuit board, and a radio module, including the electronic circuitry and components to drive the device, mounted on an outer layer of the circuit board. The inner layer and outer layer, as used herein, can include a metal material. Accordingly, the antenna may be isolated from the flammable environment and/or resistant to creating a spark without covering the antenna in an epoxy. Further, by locating the antenna in a circuit board layer that is one layer beneath or above an outer layer of the circuit board in accordance with one or more embodiments of the present disclosure, the RF capabilities of the radio device may be greater than previous radio devices.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of radio devices" can refer to one or more radio devices. Additionally, the designator "N" as used herein, particularly with respect to reference numerals in the drawings, indicate that a number of the particular feature so designated can be included with a number of embodiments of the present disclosure.

Figure 1B:
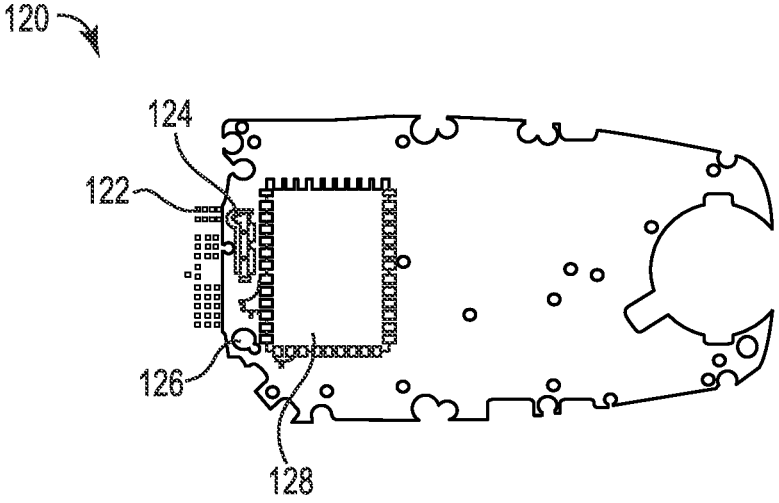
FIG. 1B illustrates a first layer of a circuit board of a safety radio device in accordance with one or more embodiments of the present disclosure.

FIG. 1A illustrates a second layer 110 of a circuit board of a safety radio device in accordance with one or more embodiments of the present disclosure. FIG. 1B illustrates a first layer 120 of a circuit board of a safety radio device in accordance with one or more embodiments of the present disclosure. Second layer 110 can be, for example, an inner layer of the circuit board, and first layer 120 can be, for example, an outer layer of the circuit board. The inner layer of the circuit board can include a layer of the circuit board that is one layer beneath the top (e.g., outer) layer or one layer above the bottom (e.g., outer) layer of the circuit board.

Although two layers of the circuit board are illustrated in FIGS. 1A and 1B, circuit boards in accordance with the present disclosure can include one or more additional layers not shown in FIGS. 1A and 1B. For simplicity and so as not to obscure embodiments of the present disclosure, additional layers are not shown in FIGS. 1A and 1B. For example, the circuit board can include six layers, with the inner, second layer being the fifth layer and the outer, first layer being the sixth layer.

A circuit board as used herein can include a printed circuit board (PCB) such as a PCB made of an isolating material and/or dielectric material. An isolating material and/or dielectric material can, for instance, include a Flame Resistant 4 (FR-4) material, for example. FR-4 material can include a composite material composed of woven fiberglass cloth with an epoxy resin binder that is flame resistant. A PCB can be used to mechanically support and/or electronically connect electronic components using conductive pathways, tracks, and/or signal traces etched from copper sheets (e.g., layers) laminated onto a non-conductive substrate (e.g., an FR-4 material), for example. The PCB, for instance, can typically be fabricated by assembling multiple layers each separated by a layer of FR-4 material. Layers, as used herein, can refer to a metal layer of a circuit board and not the isolating FR-4 material between the metal layers.

The inner layer of the circuit board 110 can include an antenna 112, as shown in FIG. 1A. In some embodiments of the present disclosure, the antenna 112 can extend out from a grounding material 118. The grounding material 118 can surround a strip line 116 printed on the inner layer of the circuit board 110 that electronically connects the antenna 112 to an aperture (e.g., via, hole and/or opening) 114 formed in between the inner layer 110 and the outer layer 120 of the circuit board. For instance, the aperture can be formed in an isolating material (e.g., FR-4 material) positioned between the inner layer 110 and outer layer 120.

An aperture 114 (e.g., a via) can include a launching point to another layer in the circuit board (e.g., the outer layer). For example, the launching point can include a pad of a via. A via can include an electrical connection between different layers of circuit board (e.g., metal layers 110 and 120), for example, as will be further described herein.

Grounding material 118 can include, for example, conductive material that can form a complete circuit. The voltage on antenna 112 can oscillate with respect to the grounding material 118 for RF signaling.

The outer layer of the circuit board 120 can include an area 128 for a radio module to be mounted to the board. The radio module can include electronics to enable the safety radio device to communicate wirelessly, for example. For instance, the radio module can include a transmitter and/or a receiver for sending and/or receiving, respectively, RF signals to and/or from, respectively, an additional device (not shown in FIG. 1). The radio module can use the antenna 112 for RF transmission and/or reception, for example.

In order to avoid ignition of potential gas in the environment around the safety radio device, the radio module can be partially or completely covered in an isolating material. The isolating material covering the radio module can include an epoxy material, for example. Covering the radio module in an epoxy material can prevent a spark from occurring and/or can isolate a spark from the environment that may otherwise have been sufficient for creating a danger in a hazardous environment, such as a flame and/or explosion. By isolating the radio module, any ignition event that may occur with the radio module cannot access the hazardous environment to cause ignition.

The antenna 112, located on the inner layer of the circuit board 110, may not be covered in an epoxy material. Locating the antenna 112 in the inner layer of the circuit board 110 can contain any spark created by the antenna 112 in the circuit board, and therefore the antenna 112 may not need an epoxy coating, other than that provided by the isolating material (e.g., FR-4 material) of the PCB itself, because the antenna 112 is isolated from the hazardous environment by the isolating material of the circuit board.

Further, locating the antenna 112 in the inner layer of the circuit board 110 may not adversely affect the efficiency of the safety radio device. Efficiency of the safety radio device can include the ratio of the power actually radiated in all directions to the power fed to the antenna 112.

In some embodiments of the present disclosure, the antenna 112 can be connected to the radio module through aperture 114. The aperture 114 can form part of a via. A via can include an electrical connection (e.g., vertical connection) between different layers of conductors in a printed circuit, for example. A via can be formed, for instance, by drilling a small hole and filling the hole with conductive material (e.g, conductive tube filing). For instance, a via between inner layer 110 and outer layer 120 can electrically connect layers 110 and 120. If the hole passes through the entire PCB, it is a through via, for instance.

A via in a PCB can include two pads, in corresponding positions on different layers of the board (e.g., layers 110 and 120), that are electrically connected by conductive material within an aperture through the board (e.g., aperture 114). The aperture can be made conductive, for example, by electroplating. Electroplating can include a plating process in which metal ions in a solution are moved by an electric field to coat an electrode, for example.

In some embodiments, a barrel can be positioned inside the aperture and can include a conductive tube filling the aperture. A pad can connect each end of the barrel to a trace located on a layer (e.g., metal layer) of the circuit board connected by the aperture (e.g., first layer and second layer). For example, a trace can include a transmission line, such as a strip line 116 printed on the inner layer of the circuit board 110 and a microstrip line printed on the outer layer of the circuit board 120. The via can include a clearance aperture between a barrel and a no-connect metal layer, called an antipad. A no-connect metal layer can include a ground plane and/or a power plane on a layer of the circuit board. Each pad of the via, for instance, may not be in contact with the no-connect metal layer. For example, the antipad can include a space (e.g., void) between a pad of the via and the no-connect metal layer.

In one or more embodiments of the present disclosure, the via can be a partial via and/or a blind via that extends from an outer layer of the circuit board 120 to an inner layer of the circuit board 110. A partial via and/or a blind via, for instance, can include a via that extends through part of a circuit board but does not extend through all layers of the circuit board. A partial via and/or blind via can be exposed on only one side of the circuit board, for example. By contrast, a through via passes entirely through all layers of the PCB.

For instance, a partial via and/or blind via can provide advantages over a through via. A through via may require, for instance, that a side of the via opposite of the radio module be covered with an isolating material and/or an epoxy material. Further, a partial via and/or blind via can provide a more controlled signal path than a through via. For instance, a high frequency impedance of a signal path can be more difficult to control with a through via than a partial via and/or blind via.

The partial via and/or blind via can electronically connect the strip line 116 from the antenna 112 in the inner layer of the circuit board 110 to a microstrip line (e.g., not show in FIG. 1B) printed on the outer layer of the circuit board 120. The microstrip line can be electronically connected to a coaxial RF connector 126. A coaxial RF connector 126 can include a U.FL connector, for example. The U.FL connector may be used to connect the microstrip line to the radio module. Alternatively, the radio module may connect directly to the microstrip line.

An RF connector can include, for instance, an electrical connector designed to work at RF in the 2.4 Gigahertz Industrial, Scientific, and Medical (ISM) band frequency range. A coaxial RF connector can use a coaxial cable.

The microstrip line printed on the outer layer of the circuit board 120 can be located across and/or nearby a tuning component 124. A tuning component 124 can include an inductor and/or a capacitor, for example.

In some embodiments of the present disclosure, a plurality of through vias 122 on the circuit board 110 can be used to electrically connect multiple layers of the PCB. For instance, the plurality of through vias 122 can be located around a feed line leading to the antenna (e.g., not shown in FIG. 1B). The plurality of through vias 122 can, for example, connect grounding material 118 on the inner layer of the circuit board 110 to grounding material on the outer layer of the circuit board 120.

Figure 2:
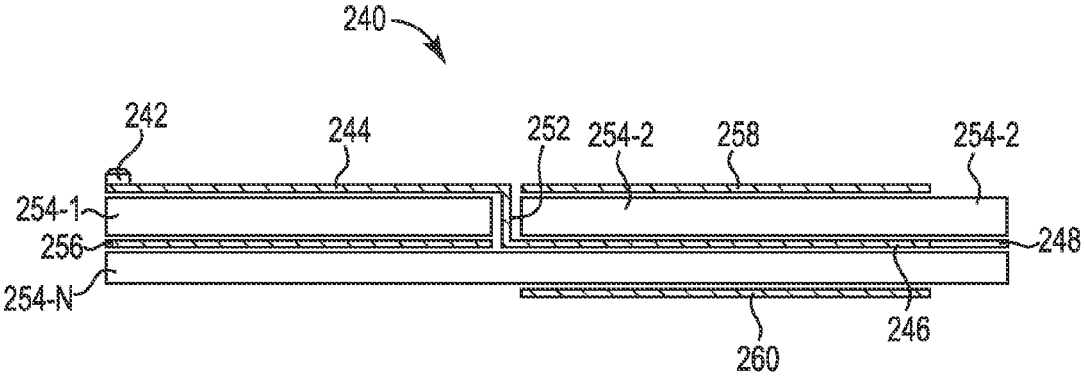
FIG. 2 illustrates a cross-sectional view of a multilayer circuit board of a safety radio device in accordance with one or more embodiments of the present disclosure.

FIG. 2 illustrates a cross-sectional view of a multilayer circuit board 240 of a safety radio device in accordance with one or more embodiments of the present disclosure. As shown in FIG. 2, the multilayer circuit board 240 can include a number of layers 244 and 258, 246 and 256, and 260. In some embodiments, the number of layers in multilayer circuit board 240 can be six layers. However, embodiments of the present disclosure are not limited to a particular number of layers. In some embodiments, the layers 244 and 258, 256 and 246, and 260 of the circuit board 240 can include layers of metal material separated by isolating material 254-1, 254-2 . . . 254-N, for example.

As shown in FIG. 2, isolating material 254-1, 254-2 . . . 254-N can be located between each layer of the circuit board 244 and 258, 256 and 246, and 260 (e.g., printed metal layer). The isolating material 254-1, 254-2 . . . 254-N can include layers of isolating material between metal layers of the circuit board 244 and 258, 256 and 246, and 260, for example. Isolating material between each layer of the circuit board 244 and 258, 256 and 246, and 260 can include a dielectric material, for instance. A dielectric material can include, for example, an electrical insulator that can be polarized by an applied electric field. As an example, a dielectric material and/or isolating material can include a FR-4 material.

The second layer of the circuit board 246 and 256 can be an inner layer of the circuit board 240. For example, the second layer of the circuit board 246 and 256 can be the second layer or the fifth layer of a six layer circuit board. For instance, the second layer of the circuit board 246 and 256 can be one layer below a top layer of a six layer circuit board (e.g., second layer) or one layer above a bottom layer of a six layer circuit board (e.g., fifth layer). An antenna 248 can be implemented by controlling the shape of the metal on the second layer of the circuit board 246 and 256

The first layer of the circuit board 244 and 258 can be an outer layer of the circuit board 240. For example, the first layer of the circuit board 244 and 258 can be the first layer or sixth layer of a six layer circuit board. For instance, the first layer of the circuit board 244 and 258 can be a top layer of a six layer circuit board (e.g., first layer) or a bottom layer of a six layer circuit board (e.g., sixth layer).

As shown in FIG. 2, a strip line 246 can be printed on the second layer 246 and 256 of the circuit board 240. The strip line 246 can electronically connect the antenna 248 to a pad of a via 252. The via 252 can be a partial via and/or a blind via that extends between the first layer of the circuit board 244 and 258 to the second layer of the circuit board 246 and 256. The strip line 246 can be surrounded by grounding material 258 printed on the first layer 244 and 258 and grounding material printed on a third layer 260 located after the via 252. The strip line 246 may be surrounded by grounding material 256 printed on the second layer 246 and 256, for instance.

As illustrated in the embodiment of FIG. 2, the antenna 248 (e.g., a radiating element of the antenna implemented at the $2^{nd}$ layer) can extend beyond a metal material of the first layer 244 and 258 and a third layer 260 of the circuit board 240. The antenna 248 can extend beyond all remaining metal material of all other metal layers of the multilayer circuit board 240 but not beyond isolating material 254-2 and 254-N in between the metal layers of circuit board 240, for instance. Thereby, the antenna 248 can, for instance, be implemented within an inner layer of the circuit board and extend beyond remaining metal material of all layers of the circuit board (e.g., grounding material 258 of the first layer 244 and grounding material 260 and the third layer).

A remaining metal material on a metal layer can include, for instance, metal material remaining after an etching process is performed on the metal layers to remove metal so that the antenna 248 is extending beyond the metal material in the circuit board 240. The antenna 248 can, in some embodiments, be the same vertical thickness as the strip line 246 that electronically connects the antenna 248 to the pad of the via 252.

The via 252 can be electronically connected to a microstrip line 244. The microstrip line 244 can be printed on the first layer of the circuit board 250-1. The microstrip line 244 can extend from the pad of the via 252 located on the first layer of the circuit board 244 and 258 to a coaxial RF connector 242.

The coaxial RF connector 242 can be electronically connected to the radio module mounted on the first layer of the circuit board 244 and 258 using a coaxial cable. The coaxial RF connector 242 may be connected to the microstrip line 244, for instance. Thereby, the radio module on the first layer of the circuit board 244 and 258 can be electronically connected to the antenna 248 mounted on the second layer of the circuit board through a via 252 extending between the first layer of the circuit board 244 and 258 and the second layer of the circuit board 246 and 256 for signaling to an additional device (not shown in FIG. 2).

Figure 3:
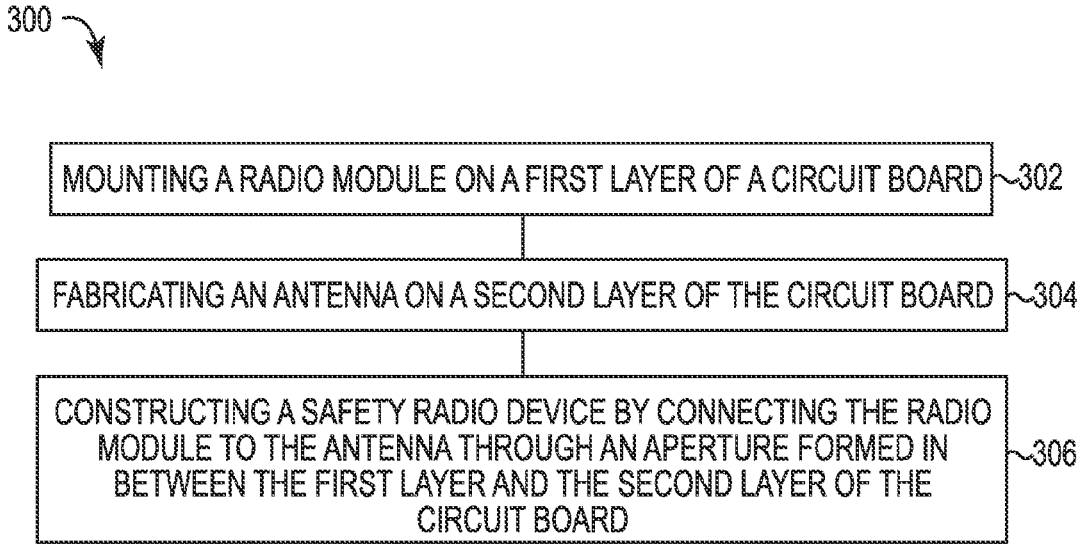
FIG. 3 illustrates a block diagram of an example of a method for construction of a safety radio device in accordance with one or more embodiments of the present disclosure.

FIG. 3 illustrates a block diagram of an example of a method 300 for construction of a safety radio device in accordance with one or more embodiments of the present disclosure. The method 300 can be used to construct a safety radio device that can perform RF signaling in a hazardous environment.

At block 302, method 300 includes mounting (e.g., placing) a radio module on a first layer of a circuit board. The radio module and the first layer of the circuit board can be, for example, the radio module and first layer of the circuit board, respectively, previously described in connection with FIGS. 1A, 1B, and 2. The radio module can include the electronic circuitry and components to drive the safety radio device.

At block 304, method 300 includes fabricating an antenna on a second layer of the circuit board. Fabricating, as used herein, can include a process of etching metal to form a desired shape. The antenna and the second layer of the circuit board can be, for example, the antenna and second layer of the circuit board, respectively, previously described in connection with FIGS. 1A, 1B, and 2.

At block 306, method 300 includes constructing a safety radio device by connecting the radio module to the antenna through an aperture (e.g., an aperture formed between the first layer and the second layer of the circuit board). The aperture can be, for example, the aperture previously described in connection with FIGS. 1A, 1B, and 2.

In one or more embodiments of the present disclosure, the aperture and at least a portion of the radio module can be covered in an isolating material. The isolating material covering the aperture and the radio module can include an epoxy material. Covering the aperture (e.g., via) and at least a portion of the radio module in an epoxy material can isolate the radio module from the environment with potential hazardous gas and/or particulates.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment

What is claimed:

1. A method of constructing a safety radio device, comprising:

coating at least a portion of a radio module in an epoxy material;

mounting the radio module on an exterior surface of the safety radio device via a first layer of a circuit board;

fabricating an antenna on a surface of a second layer of the circuit board, such that a radiating element of the antenna extends along a portion of the surface of the second layer of the circuit board and is located between the second layer of the circuit board and the first layer of the circuit board; and constructing a safety radio device by connecting the radio module to the antenna through an aperture formed in between the first layer and the second layer of the circuit board.

2. The method of claim 1, wherein connecting the radio module to the antenna through an aperture includes creating a partial via in an isolating material between the first layer of the circuit board and the second layer of the circuit board.

3. The method of claim 1, wherein the first layer and the second layer of the circuit board include a metal material.

4. The method of claim 1, wherein the method further includes coating the aperture in an isolating material.

5. The method of claim 4, wherein the isolating material includes an epoxy material.

6. The method of claim 1, wherein the antenna extends beyond a remaining metal material of multiple layers of the circuit board.

7. A safety radio device system, comprising:

a radio module mounted on an exterior surface of a first device via an outer layer of a circuit board of the first device, wherein the radio module is at least partially coated in an epoxy material;

an antenna fabricated on a surface of an inner layer of the circuit board, such that a radiating element of the antenna extends along a portion of the surface of the second layer of the circuit board and is located between the inner layer of the circuit board and the outer layer of the circuit board, wherein the antenna is connected to the radio module through a via extending between the outer layer of the circuit board and the inner layer of the circuit board; and wherein the antenna and radio module are used for signaling to a second device.

8. The system of claim 7, wherein an isolating material covers the via.

9. The system of claim 7, wherein the antenna includes a radiating element of the antenna extending out beyond a remaining metal material from multiple layers of the circuit board.

10. The system of claim 9, further including a plurality of through vias on the circuit board located around a feed line leading to the antenna.

11. A safety radio device, comprising:

a multi-layer circuit board having an inner layer and an outer layer;

an antenna fabricated on a surface of the inner layer of the circuit board, such that a radiating element of the antenna extends along a portion of the surface of the second layer of the circuit board and is located between the inner layer of the circuit board and the outer layer of the circuit board; and a radio module mounted on an exterior surface of the safety radio device via the outer layer of the circuit board, wherein the antenna is connected to the radio module through a via extending between the inner circuit board layer and the outer circuit board layer and wherein the radio module is at least partially coated in an epoxy material.

12. The safety radio device of claim 11, wherein the via includes a partial via extending between the inner circuit board layer and the outer circuit board layer but not extending to the remaining layers of the circuit board.

13. The safety radio device of claim 11, wherein the inner layer includes a layer of the circuit board that is one layer beneath the outer layer of the circuit board.

14. The safety radio device of claim 11, wherein the inner layer of the circuit board and the outer layer of the circuit board comprise a metal material.

15. The safety radio device of claim 11, wherein the via is covered in an epoxy material.

16. The safety radio device of claim 11, further including an isolating material between each layer of the multilayer circuit board, wherein the isolating material comprises a Flame Retardant 4 (FR-4) material.

17. The safety radio device of claim 11, wherein the via is located in an isolating material between the inner layer and the outer layer of the circuit board.

18. The safety radio device of claim 11, wherein the via is connected to the radio module by a coaxial radio frequency (RF) connector.

19. The safety radio device of claim 11, wherein the device further includes a tuning component connected to the via and located on the outer layer of the circuit board.

* * * * *